US009169573B2

(12) United States Patent
Hadwen

(10) Patent No.: US 9,169,573 B2
(45) Date of Patent: Oct. 27, 2015

(54) AM-EWOD DEVICE AND METHOD OF DRIVING WITH VARIABLE VOLTAGE AC DRIVING

(71) Applicant: SHARP KABUSHIKI KAISHA, Osaka (JP)

(72) Inventor: Benjamin James Hadwen, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 295 days.

(21) Appl. No.: 13/747,597

(22) Filed: Jan. 23, 2013

(65) Prior Publication Data

US 2014/0202863 A1 Jul. 24, 2014

(51) Int. Cl.

| | |
|---|---|
| ***C25B 15/00*** | (2006.01) |
| ***B01L 3/00*** | (2006.01) |
| ***G09G 3/34*** | (2006.01) |

(52) U.S. Cl.

CPC ..... *C25B 15/00* (2013.01); *B01L 3/502792* (2013.01); *G09G 3/348* (2013.01); *B01L 2200/0673* (2013.01); *B01L 2300/0645* (2013.01); *B01L 2300/089* (2013.01); *B01L 2300/0816* (2013.01); *B01L 2300/161* (2013.01); *B01L 2400/0427* (2013.01); *G09G 2230/00* (2013.01); *G09G 2300/0819* (2013.01); *G09G 2300/0857* (2013.01); *G09G 2320/0693* (2013.01)

(58) Field of Classification Search

None

See application file for complete search history.

(56) References Cited

U.S. PATENT DOCUMENTS

| | | | | |
|---|---|---|---|---|
| 6,565,727 | B1 * | 5/2003 | Shenderov | 204/600 |
| 6,911,132 | B2 | 6/2005 | Pamula et al. | |
| 7,163,612 | B2 | 1/2007 | Sterling et al. | |
| 8,173,000 | B1 * | 5/2012 | Hadwen et al. | 204/450 |
| 2004/0055891 | A1 | 3/2004 | Pamula et al. | |
| 2011/0180571 | A1 | 7/2011 | Srinivasan et al. | |

(Continued)

FOREIGN PATENT DOCUMENTS

| | | |
|---|---|---|
| CN | 102866193 A | 1/2013 |
| EP | 2404675 | 1/2012 |
| JP | 2010-188265 | 9/2010 |
| JP | 2012-230105 | 11/2012 |

(Continued)

OTHER PUBLICATIONS

R.B. Fair; "Digital microfluidics: is a true lab-on-a-chip possible?"; Microfluid Nanofluid; 2007.

*Primary Examiner* — Luan Van

*Assistant Examiner* — Steven Rosenwald

(74) *Attorney, Agent, or Firm* — Renner, Otto, Boisselle & Sklar, LLP

(57) ABSTRACT

An active matrix electrowetting on dielectric (AM-EWOD) device includes a substrate electrode and a plurality of array elements, each array element including an array element electrode. The AM-EWOD device further includes thin film electronics disposed on a substrate. The thin film electronics includes first circuitry configured to supply a first time varying signal V1 to the array element electrodes, and second circuitry configured to supply a second time varying signal V2 to the substrate electrode. An actuation voltage is defined by a potential difference between V2 and V1, and the first circuitry further is configured to adjust the amplitude of V1 to adjust the actuation voltage. V1 may be adjusted to adjust the actuation voltage while V2 remains unchanged. The actuation voltage may be controlled to operate the AM-EWOD device between high and low voltage modes of operation in accordance with different droplet manipulation operations to be performed.

16 Claims, 12 Drawing Sheets

(56) References Cited

U.S. PATENT DOCUMENTS

2012/0007608 A1 1/2012 Hadwen et al.
2012/0268804 A1 10/2012 Hadwen

FOREIGN PATENT DOCUMENTS

WO WO 03/045556 A2 6/2003
WO WO 2014/036915 3/2014

* cited by examiner

Figure 1: CONVENTIONAL ART

88
VBIAS1
S1
VBIAS2
VBIAS3
S1
VBIAS4
VIN
VH
VL
VOUT
90A
VIN
VH
VL
VOUT
90B
V1A
V1A
V1A
V1A
V1B
V1B
V1B
V1B
row1
row2
row3
row4
row5
row6
row7
row8

88B
VBIAS1
S1
VBIAS2
VBIAS1
S1
VBIAS2
VH
VL
VOUT
90A
VH
VL
VOUT
90B
V1A
V1B
R1
R2
R3
R
IN1
IN2
OUT
92
row1
row2
row3

AM-EWOD DEVICE AND METHOD OF DRIVING WITH VARIABLE VOLTAGE AC DRIVING

TECHNICAL FIELD

The present invention relates to active matrix arrays and elements thereof. In a particular aspect, the present invention relates to digital microfluidics, and more specifically to Active Matrix Electrowetting-On-Dielectric (AM-EWOD). Electrowetting-On-Dielectric (EWOD) is a known technique for manipulating droplets of fluid on an array. Active Matrix EWOD (AM-EWOD) refers to implementation of EWOD in an active matrix array, for example by using thin film transistors (TFTs). The invention further relates to methods of driving such a device.

BACKGROUND ART

Electrowetting on dielectric (EWOD) is a well known technique for manipulating droplets of fluid by application of an electric field. It is thus a candidate technology for digital microfluidics for lab-on-a-chip technology. An introduction to the basic principles of the technology can be found in "Digital microfluidics: is a true lab-on-a-chip possible?", R. B. Fair, Microfluid Nanofluid (2007) 3:245-281).

FIG. 1 shows a part of a conventional EWOD device in cross section. The device includes a lower substrate 72, the uppermost layer of which is formed from a conductive material which is patterned so that a plurality of electrodes 38 (e.g., 38A and 38B in FIG. 1) are realized. The plurality of electrodes may be termed the EW drive elements. The droplet 4, consisting of a polar material (which is commonly also ionic), and is constrained in a plane between the lower substrate 72 and a top substrate 36. A suitable gap between the two substrates may be realized by means of a spacer 32, and a non-polar fluid 34 (e.g. oil) may be used to occupy the volume not occupied by the liquid droplet 4. An insulator layer 20 disposed upon the lower substrate 72 separates the conductive electrodes 38A, 38B from a first hydrophobic surface 16 upon which the liquid droplet 4 sits with a contact angle 6 represented by θ. On the top substrate 36 is a second hydrophobic layer 26 with which the liquid droplet 4 may come into contact. Interposed between the top substrate 36 and the second hydrophobic layer 26 is a top substrate electrode 28.

The contact angle θ6 is defined as shown in FIG. 1, and is determined by the balancing of the surface tension components between the solid-liquid ($\gamma_{SL}$), liquid-gas ($\gamma_{LG}$) and non-ionic fluid ($\gamma_{SG}$) interfaces, and in the case where no voltages are applied satisfies Young's law, the equation being given by:

$$\cos\theta = \frac{\gamma_{SG} - \gamma_{SL}}{\gamma_{LG}} \quad \text{(equation 1)}$$

In certain cases, the relative surface tensions of the materials involved (i.e the values of $\gamma_{SL}$, $\gamma_{LG}$ and $\gamma_{SG}$) may be such that the right hand side of equation (1) is less than −1. This may commonly occur in the case in which the non-ionic fluid 34 is oil. Under these conditions, the liquid droplet 4 may lose contact with the hydrophobic surfaces 16 and 26, and a thin layer of the non-polar fluid 34 (oil) may be formed between the liquid droplet 4 and the hydrophobic surfaces 16 and 26.

In operation, voltages termed the EW drive voltages, (e.g. $V_T$, $V_0$ and $V_{00}$ in FIG. 1) may be externally applied to different electrodes (e.g. drive element electrodes 28, 38A and 38B, respectively). The resulting electrical forces that are set up effectively control the hydrophobicity of the hydrophobic surface 16. By arranging for different EW drive voltages (e.g. $V_0$ and $V_{00}$) to be applied to different drive element electrodes (e.g. 38A and 38B), the liquid droplet 4 may be moved in the lateral plane between the two substrates 72 and 36.

U.S. Pat. No. 6,565,727 (Shenderov, issued May 20, 2003) discloses a passive matrix EWOD device for moving droplets through an array.

U.S. Pat. No. 6,911,132 (Pamula et al., issued Jun. 28, 2005) discloses a two dimensional EWOD array to control the position and movement of droplets in two dimensions.

U.S. Pat. No. 6,565,727 further discloses methods for other droplet operations including the splitting and merging of droplets, and the mixing together of droplets of different materials.

U.S. Pat. No. 7,163,612 (Sterling et al., issued Jan. 16, 2007) describes how TFT based electronics may be used to control the addressing of voltage pulses to an EWOD array by using circuit arrangements very similar to those employed in AM display technologies.

The approach of U.S. Pat. No. 7,163,612 may be termed "Active Matrix Electrowetting on Dielectric" (AM-EWOD). There are several advantages in using TFT based electronics to control an EWOD array, namely:

- Driver circuits can be integrated onto the AM-EWOD array substrate.
- TFT-based electronics are well suited to the AM-EWOD application. They are cheap to produce so that relatively large substrate areas can be produced at relatively low cost.
- TFTs fabricated in standard processes can be designed to operate at much higher voltages than transistors fabricated in standard CMOS processes. This is significant since many EWOD technologies require EWOD actuation voltages in excess of 20V to be applied.

A disadvantage of U.S. Pat. No. 7,163,612 is that it does not disclose any circuit embodiments for realizing the TFT backplane of the AM-EWOD.

EP2404675 (Hadwen et al., published Jan. 11, 2012) describes array element circuits for an AM-EWOD device. Various methods are known for programming and applying an EWOD actuation voltage to the EWOD drive electrode. The voltage write function described includes a memory element of standard means, for example, based on Dynamic RAM (DRAM) or Static RAM (SRAM) and input lines for programming the array element.

U.S. Pat. No. 8,173,000 (Hadwen et al., issued May 8, 2012) describes an AM-EWOD device with array element circuit and method for writing an AC actuation voltage to the electrode. The AC drive scheme described by this patent utilizes the application of AC signals to both the drive element electrode and top substrate electrodes of the device. Therefore, the device is capable of generating a voltage difference between the electrodes that varies between $+V_{EW}$ and $-V_{EW}$, whilst the transistors in the array element circuit are only ever required to operate with a rail-to-rail voltage of $V_{EW}$. This patent further describes methods of driving the device sometimes in an AC and sometimes in a DC mode, so as to be compatible with the operation of integrated sensor functions.

US application 2012/0007608 (Hadwen et al., published Jan. 12, 2012) describes how an impedance (capacitance) sensing function can be incorporated into the array element. The impedance sensor may be used for determining the presence and size of liquid droplets present at each electrode in the array.

US application US2011/0180571 (Srinivasan et al., published Jul. 28, 2011) describes how using adjustable electrowetting voltages may help to maintain the stability of the oil film that is formed between the liquid droplet 4 and the hydrophobic surfaces 16 and 26. They describe how the maintenance of the oil film between the droplet and the surface of the droplet actuator is an important factor in optimum operation of the droplet actuator. A stabilized oil film leads to less contamination, such as contamination due to absorption and resorption. In addition, maintenance of the oil film provides for more direct electrowetting and allows for the use of lower voltages for droplet operations. They further describe how different voltages may be used for performing different operations, for example a higher voltage may be used in order to elute a droplet from a reservoir than as would be used to move a droplet between adjacent array elements.

SUMMARY OF INVENTION

An aspect of the invention is an AM-EWOD device with a modified AC drive scheme. According to a first embodiment of the invention, a time varying signal V2 is applied to the top substrate electrode, and to the drive electrodes of array elements that are unactuated. A time varying signal V1 is applied to the drive electrodes of the array elements that are actuated so that the actuation voltage that is developed is equal to V1−V2. A means is provided for adjustment of the actuation voltage by changing the amplitude of the V1 signal only whilst leaving the V2 signal unchanged.

According to a further embodiment of the invention, means are provided whereby the amplitude of signal V1 may be arranged to be different at different times and/or in different spatial regions of the device in order to realize high voltage and low voltage zones of operation.

According to a further embodiment of the invention, different droplet operations (e.g. merge and move) may be configured so as to be performed with different actuation voltages and/or in different zones of operation as operated with different amplitudes of signal V1

According to a further embodiment of the invention, different droplet operations may be configured so as to be performed with different actuation voltages and/or in different zones of operation in accordance with a sensed property of the droplet, for example its position, size or its properties with regard to the sensed capability to actuate it at different actuation voltages.

An advantage of the invention is that certain droplet operations (in particular move, merge and mix) can be undertaken with lower actuation voltages than are required for certain other droplet operations (mix, split). Performing droplet operations with a lower actuation voltage when possible helps to improve device reliability by preserving the oil layer, reducing surface contamination (bio-fouling) and minimizing power consumption by the device.

Accordingly, an aspect of the invention is an active matrix electrowetting on dielectric (AM-EWOD) device. Embodiments of the AM-EWOD device include a substrate electrode, and a plurality of array elements, each array element including an array element electrode. First circuitry is configured to supply a first time varying signal V1 to at least a portion of the array element electrodes, and second circuitry is configured to supply a second time varying signal V2 to the substrate electrode, wherein an actuation voltage is defined by a potential difference between V2 and V1. The first circuitry further is configured to adjust the amplitude of V1 to adjust the actuation voltage. The amplitude of V1 may be adjusted to adjust the actuation voltage while the amplitude of V2 remains unchanged.

Another aspect of the invention is a method of controlling an actuation voltage to be applied to a plurality of array elements of an active matrix electrowetting on dielectric (AM-EWOD) device, the AM-EWOD device having a substrate electrode and a plurality of array elements, each array element including an array element electrode, wherein the actuation voltage is defined by a potential difference between the substrate electrode and the array element electrodes. Embodiments of the method of controlling the actuation voltage include the steps of: supplying a first time varying signal V1 to at least a portion of the array element electrodes, supplying a second time varying signal V2 to the substrate electrode, and controlling the actuation voltage by adjusting the amplitude of V1 to adjust the actuation voltage. The amplitude of V1 may be adjusted to adjust the actuation voltage while the amplitude of V2 remains unchanged.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DESCRIPTION OF REFERENCE NUMERALS

Figure 1:
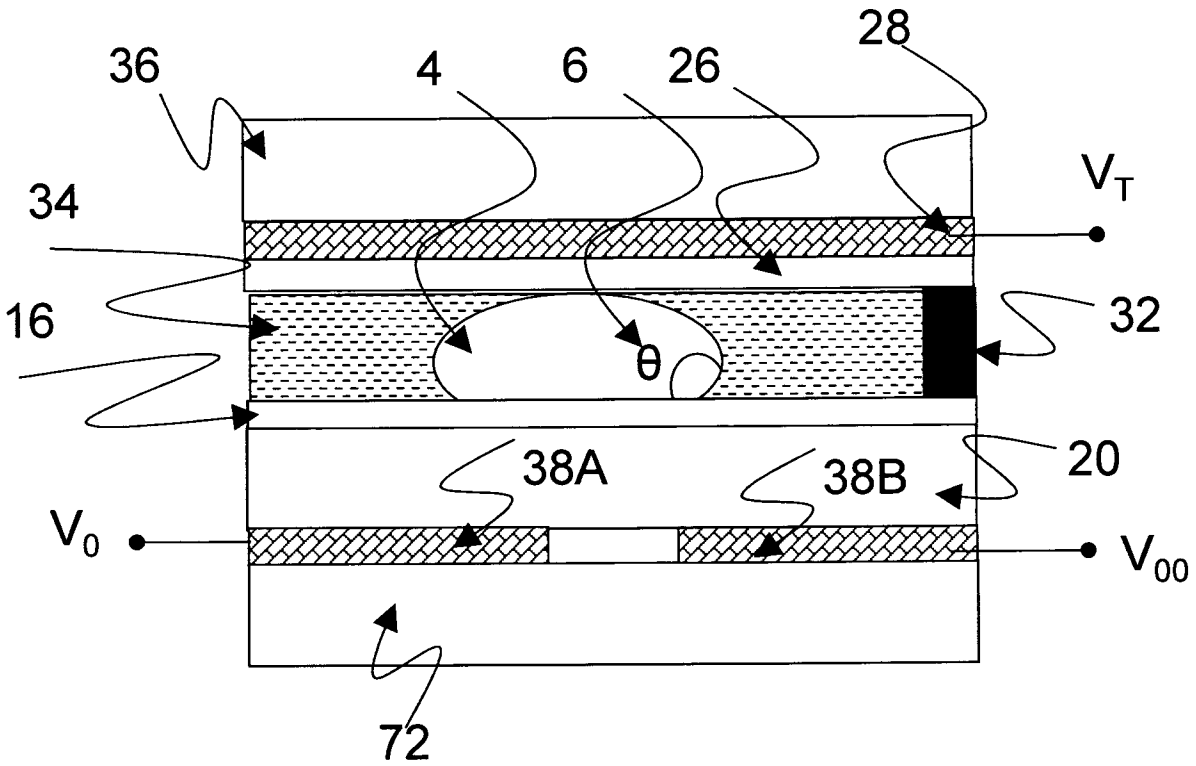
FIG. 1 is a schematic diagram depicting a conventional EWOD device in cross-section.

4 liquid droplet
6 contact angle θ
16 First hydrophobic surface
20 Insulator layer
26 Second hydrophobic surface
28 Top Substrate Electrode
32 Spacer
34 Non-ionic fluid
36 Top substrate
38/38A and 38B Array Element Electrodes
42 Electrode array
72 Substrate
74 Thin film electronics
76 Row driver circuit
78 Column driver circuit
80 Serial interface
82 Connecting wires
83 Voltage supply interface
84 Array element circuit
86 Column detection circuit
88 First signal generation circuit
88B Second signal generation circuit
90A First level shifter circuit
90B Second level shifter circuit
92 Multiplexer
100 Memory element
106 First analogue switch
108 Second analogue switch
110 Switch transistor
116 Sensor circuit
118 External drive electronics
119 Timing generation circuit
120 Voltage generation circuit
122 Control computer
123 Application software
124 High voltage zone of operation
126 Low voltage zone of operation

DETAILED DESCRIPTION OF INVENTION

Figure 2:
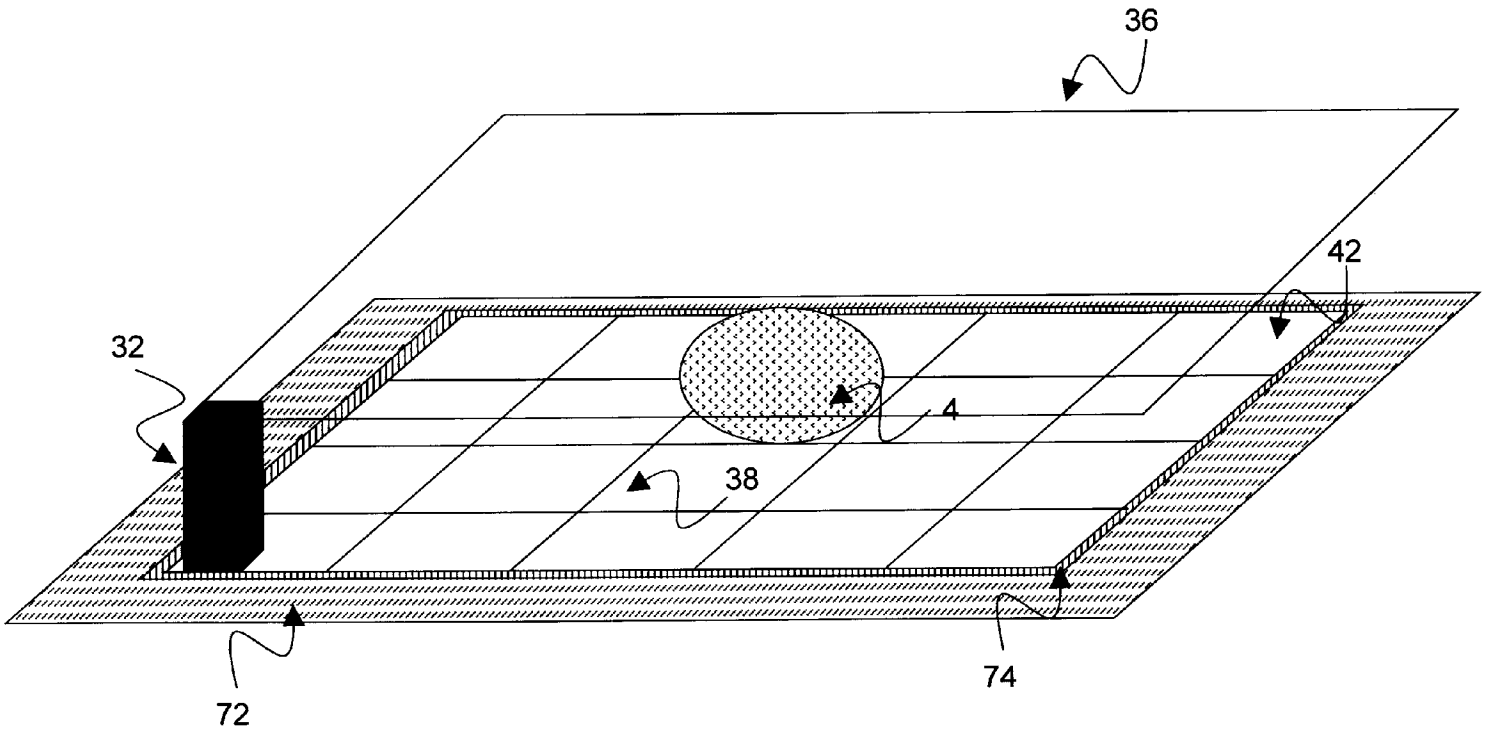
FIG. 2 is a schematic diagram depicting a an AM-EWOD device in schematic perspective in accordance with a first and exemplary embodiment of the invention.

FIG. 2 is a schematic diagram depicting an AM-EWOD device in accordance with an exemplary embodiment of the present invention. The AM-EWOD device has a lower substrate 72 with thin film electronics 74 disposed upon the substrate 72. The thin film electronics 74 are arranged to drive array element electrodes 38. A plurality of array element electrodes 38 are arranged in an electrode array 42, having M×N elements where M and N may be any number. A liquid droplet 4 of a polar liquid is enclosed between the substrate 72 and a top substrate 36, although it will be appreciated that multiple liquid droplets 4 can be present.

Figure 3:
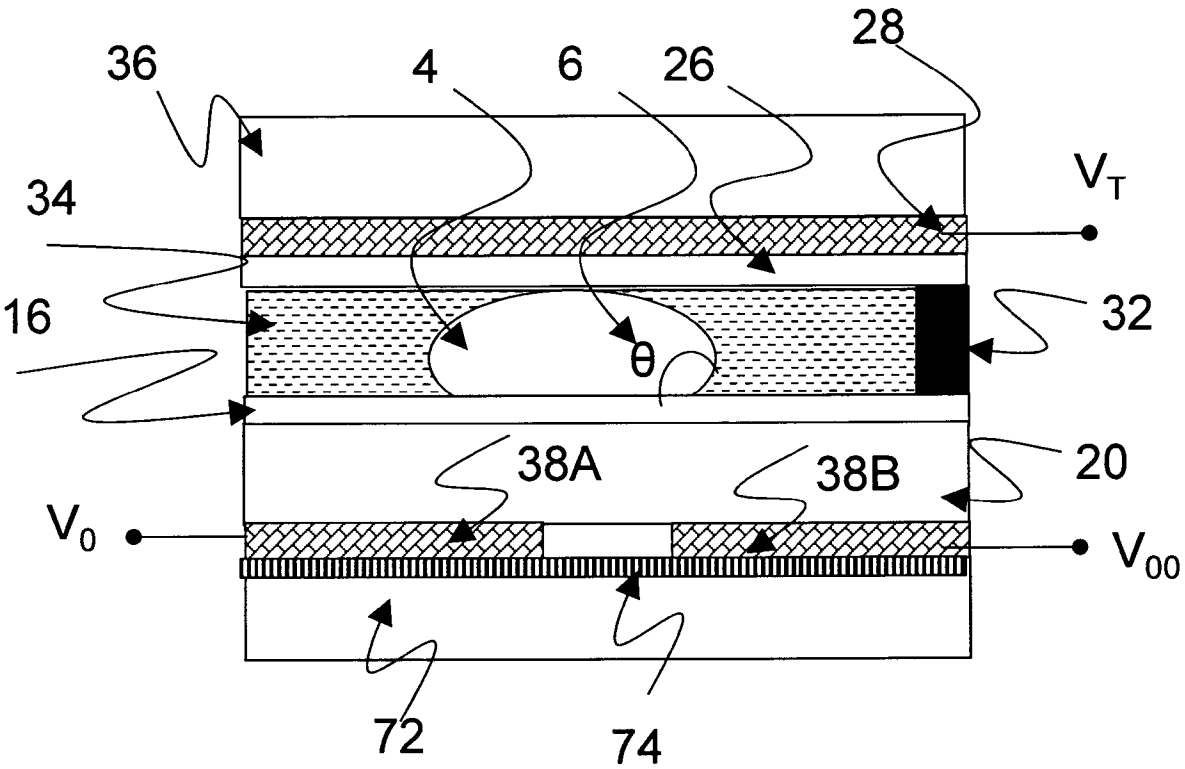
FIG. 3 shows a cross section through some of the array elements of the exemplary AM-EWOD device of FIG. 2.

FIG. 3 is a schematic diagram depicting a pair of the array elements 38A and 38B in cross section that may be utilized in the AM-EWOD device of FIG. 2. The device configuration of FIGS. 2 and 3 bears similarities to the conventional configuration shown in FIG. 1, with the AM-EWOD device of FIGS. 2 and 3 further incorporating the thin-film electronics 74 disposed on the lower substrate 72. The uppermost layer of the lower substrate 72 (which may be considered a part of the thin film electronics layer 74) is patterned so that a plurality of the array element electrodes 38 (e.g., 38A and 38B in FIG. 3) are realized. These may be termed the EW drive elements. The term EW drive element may be taken in what follows to refer both to the electrode 38 associated with a particular array element, and also to the node of an electrical circuit directly connected to this electrode 38.

Figure 4:
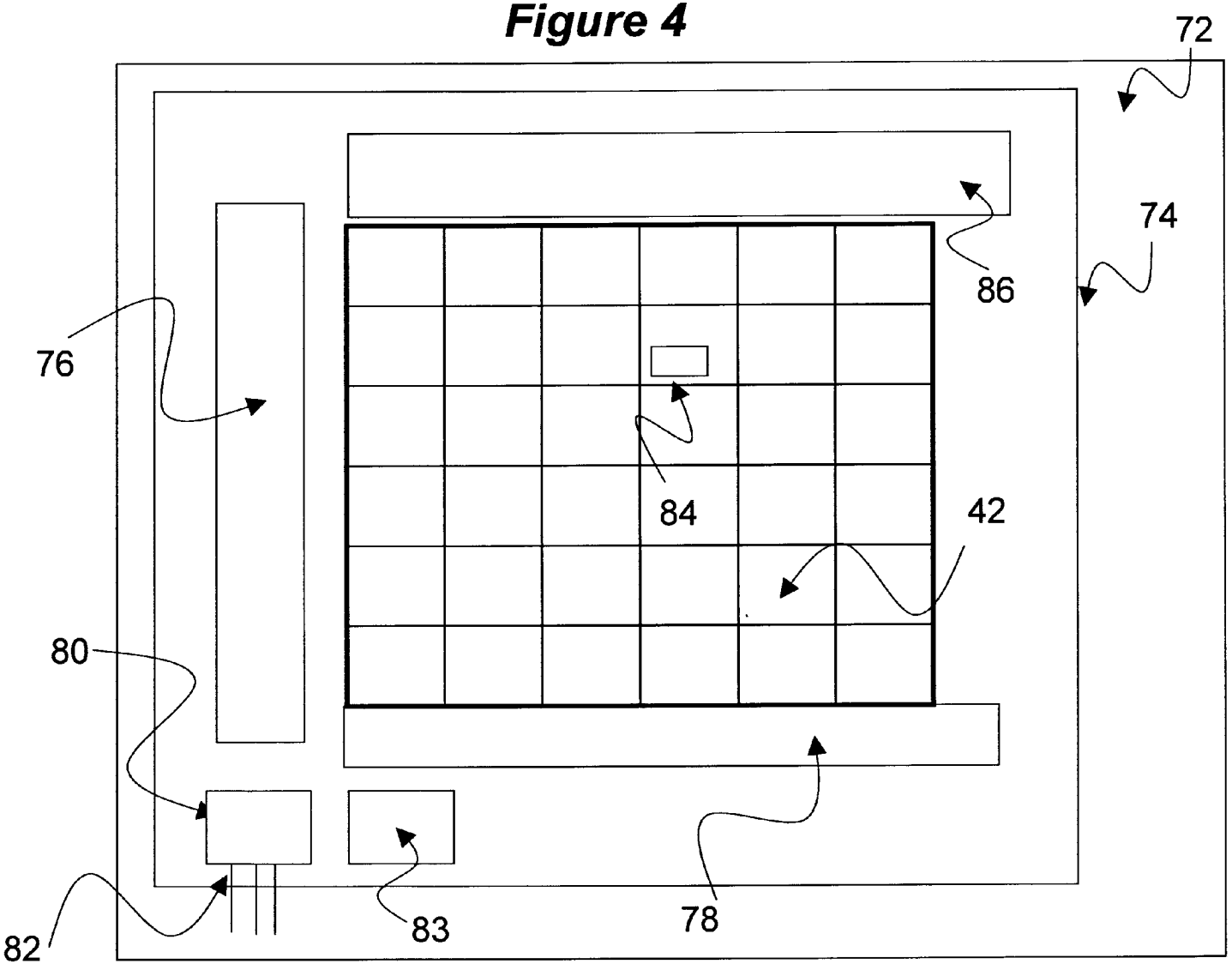
FIG. 4 is a schematic diagram depicting the arrangement of thin film electronics in the exemplary AM-EWOD device of FIG. 2.

FIG. 4 is a schematic diagram depicting an exemplary arrangement of thin film electronics 74 upon the substrate 72. Each element of the electrode array 42 contains an array element circuit 84 for controlling the electrode potential of a corresponding electrode 38. Integrated row driver 76 and column driver 78 circuits are also implemented in thin film electronics to supply control signals to the array element circuits 84.

A serial interface 80 may also be provided to process a serial input data stream and write the required voltages to the electrode array 42. A voltage supply interface 83 provides the corresponding supply voltages, top substrate drive voltages, and other requisite voltage inputs as further described herein. The number of connecting wires 82 between the array substrate 72 and external drive electronics, power supplies etc. can be made relatively few, even for large array sizes.

The array element circuit 84 may also optionally contain a sensor function which may, for example, include a means for detecting the presence and size of liquid droplets 4 at each array element location in the electrode array 42. The thin film electronics 74 may also therefore include a column detection circuit 86 for reading out sensor data from each array element and organizing such data into one or more serial output signals, which may be fed through the serial interface 80 and output from the device by means of one or more of the connecting wires 82.

Generally, an exemplary AM-EWOD device that includes thin film electronics 74 is configured as follows. The AM-EWOD device includes a substrate electrode (e.g., top substrate electrode 28) and a plurality of array elements, each array element including an array element electrode (e.g., array element electrodes 38). As further described below, the AM-EWOD device further includes first circuitry configured to supply a first time varying signal V1 to at least a portion of the array element electrodes, and second circuitry configured to supply a second time varying signal V2 to the substrate electrode. An actuation voltage is defined by a potential difference between V2 and V1, and the first circuitry further is configured to adjust the amplitude of V1 to adjust the actuation voltage. In exemplary embodiments, V1 is adjusted to adjust the actuation voltage while V2 remains unchanged.

Relatedly, the AM-EWOD device is configured to perform a method of controlling an actuation voltage to be applied to a plurality of array elements. The AM-EWOD includes a substrate electrode and the plurality of array elements, each array element including an array element electrode. The actuation voltage is defined by a potential difference between the substrate electrode and the array element electrodes. The method of controlling the actuation voltage includes the steps of supplying a first time varying signal V1 to at least a portion of the array element electrodes, supplying a second time varying signal V2 to the substrate electrode, and controlling the actuation voltage by adjusting the amplitude of V1 to adjust the actuation voltage.

Figure 5:
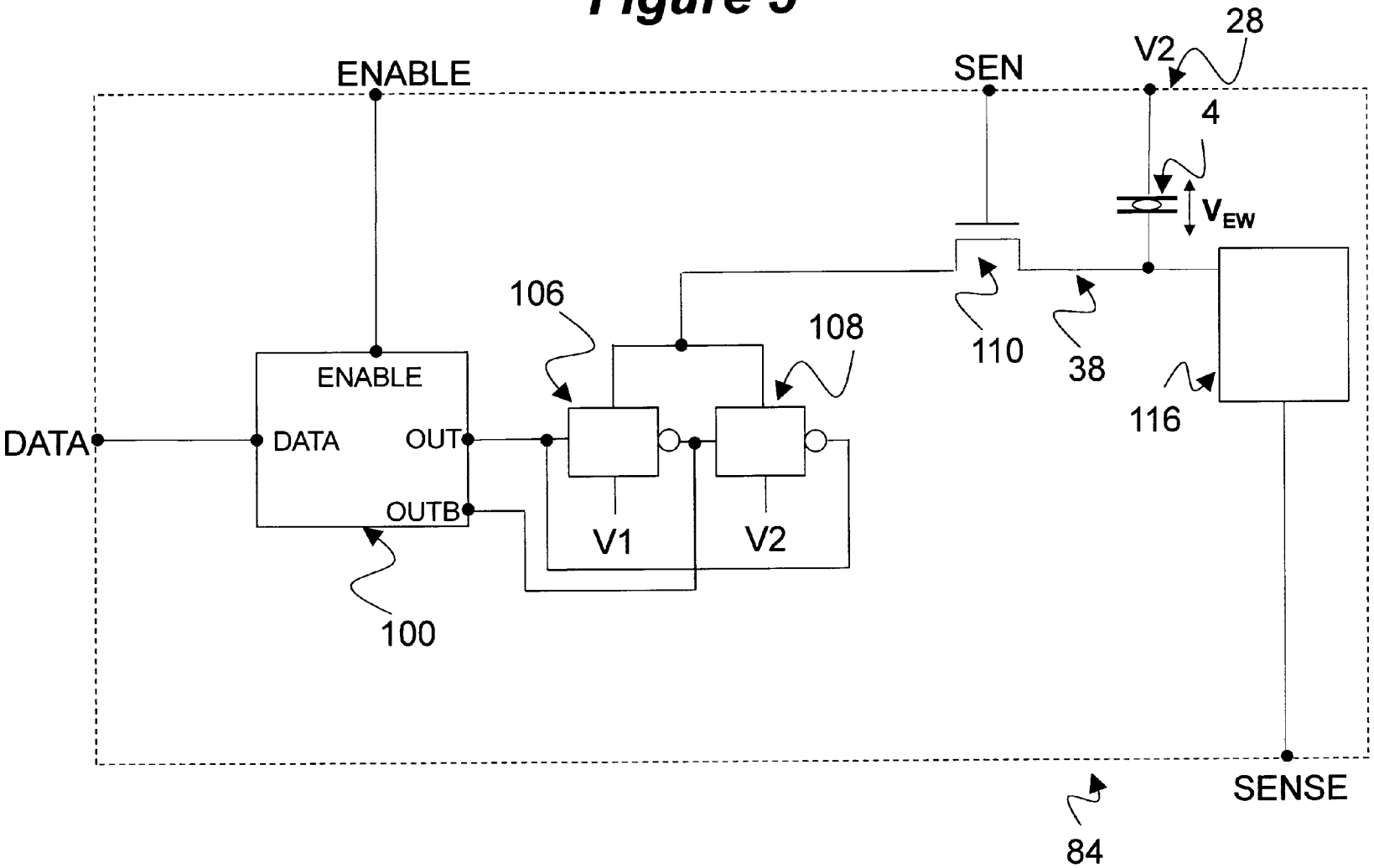
FIG. 5 is a schematic diagram depicting the array element circuit for use in the array elements of the exemplary AM-EWOD device of FIG. 2.

FIG. 5 is a schematic diagram depicting an exemplary configuration of the array element circuit 84 according to a first embodiment. The remainder of the AM-EWOD device is of the standard construction previously described with respect to FIGS. 2-4 and includes a top substrate 36 having a top substrate electrode 28.

In the exemplary configuration of FIG. 5, each array element circuit 84 contains:

A memory element 100

First circuitry including a first analogue switch 106

Second circuitry including a second analogue switch 108

A switch transistor 110.

The array element may also optionally contain

A sensor circuit 116.

The array element circuit 84 is connected as follows:

The input DATA, which may be common to all elements in the same column of the array, is connected to the DATA input of the memory element 100. The input ENABLE, which may be common to all elements in the same row of the array, is connected to the input ENABLE of the memory element 100. The output OUT of the memory element 100 is connected to the gate of the n-type transistor of first analogue switch 106 and to the gate of the p-type transistor of second analogue switch 108. The output OUTB of the memory element 100 is connected to the gate of the p-type transistor of first analogue switch 106 and to the gate of the n-type transistor of second analogue switch 108. A supply voltage waveform V1 is connected to the input of first analogue switch 106, and a supply voltage waveform V2 is connected to the input of second analogue switch 108, where both V1 and V2 may be common to all elements within the array. The output of first analogue switch 106 is connected to the output of second analogue switch 108, which in turn is connected to the source of switch transistor 110. The input SEN, which may be connected to all elements in the same row of the array, is connected to the gate of switch transistor 110. The drain of switch transistor 110 is connected to the electrode 38. The sensor circuit 116, having an output SENSE, may also be connected to the electrode 38.

The memory element 100 may be an electronic circuit of standard means capable of storing a data voltage, for example a Dynamic Random Access Memory (DRAM) cell or a Static Random Access Memory (SRAM) cell as commonly used by those of ordinary skill in the art.

The electrical load presented between the array element electrode 38 and top substrate electrode 28 is a function of whether or not a liquid droplet 4 is present at the location of the array element, and may be approximately represented as a capacitor as shown in FIG. 5. The driving signal V2 is also connected to the top substrate electrode 28 which may be common to all elements within the array. The actuation voltage at a given array element may be defined as the potential difference between the array element electrode 38 and the top substrate electrode 28.

The sensor circuit 116 may be an electronic circuit of standard means capable of detecting the presence or a property associated with a liquid droplet 4 being present at the location of the array element. Example constructions of sensor circuits are contained in US application 2012/0007608 referenced in the background art section.

The operation of the array element circuit 84 is described as follows:

Digital data may be written to the memory element 100 by standard means as is well known, the data bit, digital "1" or digital "0", corresponding to high or low voltage levels respectively being programmed to the input line DATA. The data is written to the memory cell 100 when input ENABLE is briefly activated and remains stored in the memory cell 100, regardless of the voltage level on input DATA, until such a time as ENABLE is reactivated. In this way data may be written to each memory element 100 in the array in turn. In the case where digital "1" is written to the memory element 100, the output OUT is at a high voltage level and output OUTB is at a low voltage level. Accordingly, under these circumstances, first analogue switch 106 is turned on and second analogue switch 108 is turned off. In the event that input SEN is also held high, switch transistor 110 is turned on and the voltage signal V1 is connected to the array element electrode 38. In the case where digital "0" is written to the array element, the output OUT is at low voltage level and output OUTB is at high voltage level. Accordingly first analogue switch 106 is turned off, second analogue switch 108 is turned on, and when switch transistor 110 is turned on by the input SEN the voltage signal V2 is connected to the electrode 38. Therefore, either signal V1 or signal V2 may be electrically connected to the electrode 38 in accordance with the data written and stored in the memory.

When the switch transistor 110 is turned on by the input SEN, the actuation voltage is therefore given by:

V1−V2, in the case where a digital "1" is written to the memory element 100, and V2−V2=0 Volts in the case where a digital "0" is written to the memory element 100.

The purpose of the switch transistor 110 is to provide the capability of isolating the electrode 38 from the signals V1 and V2. Such electrical isolation occurs when the input SEN is taken low so that transistor 110 is switched off. Electrical isolation may be required during operation of the sensor circuit 116, as described for example in US application 2012/0007608 and referenced in the background art section.

Figure 6:
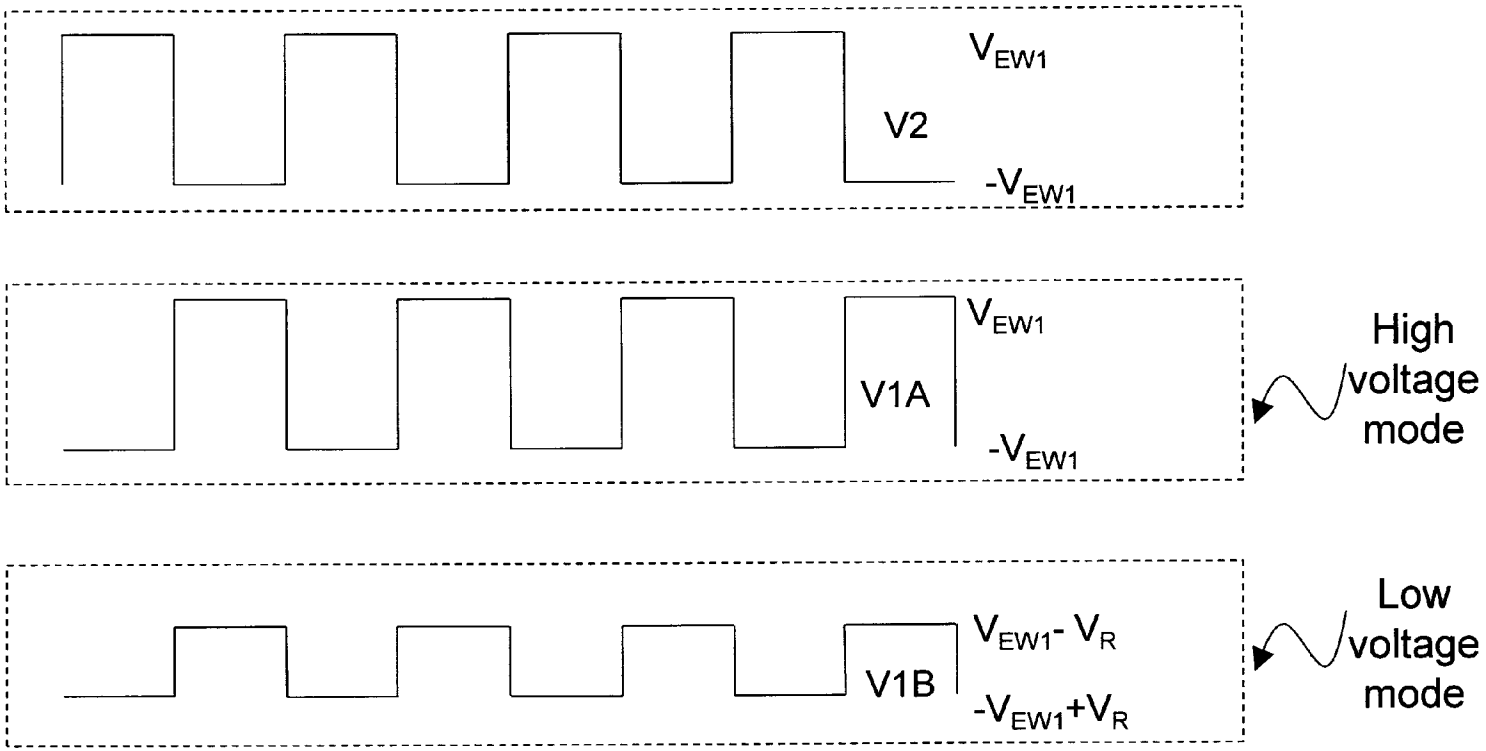
FIG. 6 is a graphical representation of the timings and voltage levels of the driving signals V1 and V2 utilized in the exemplary AM-EWOD device of FIG. 2.

FIG. 6 is a graphical depiction of an exemplary timing sequence and voltage levels of the V1 and V2 signals. The signal V2 is a squarewave voltage pulse having a voltage high level of $V_{EW1}$ and a voltage low level of $-V_{EW1}$. The signal V1 is a squarewave voltage pulse in antiphase to V2, i.e., when V2 is at its high level, V1 is at its low level and vice versa.

First circuitry for supplying the first time varying voltage signal V1, as referenced above, may include voltage supply circuitry, circuitry associated with the memory element 100, and the first analogue switch 106. Second circuitry for supplying the second time varying voltage signal V2, as referenced above, may include voltage supply circuitry, circuitry associated with the memory element 100, and the second analogue switch 108. The first circuitry for supplying the first time varying signal V1 is arranged to be configurable in such a way that both its high voltage level and low voltage level can be adjusted. Thus, V1 may be configured such that the AM-EWOD device is made to operate in either a high voltage mode or in a low voltage mode, as follows:

In high voltage mode, the high level voltage of V1 is $V_{EW1}$ and the low level voltage is $-V_{EW1}$.

In low voltage mode, the high level voltage of V1 is $V_{EW1}-V_R$ and the low level voltage is $-V_{EW1}+V_R$, where $V_R$ is a DC voltage level which may take a value between 0 and $V_{EW1}$ and is applied to the first time varying signal V1.

In the case in which a digital 1 has been written to the memory element 100 and the switch transistor 110 is turned on, a signal $V_{ACTUATE}$=V1−V2 is developed between the array element electrode 38 and top substrate electrode 28. The characteristics of this signal are as follows (see again FIG. 6):

In high voltage mode of operation, $V_{ACTUATE}$=V1A and is a square wave signal of high level $V_{EW1}$ and low level $-V_{EW1}$ (peak to peak amplitude is $2V_{EW1}$)

In low voltage mode of operation, $V_{ACTUATE}$=V1B and is a square wave signal of high level $V_{EW1}-V_R$ and low level $-V_{EW1}+V_R$ (peak to peak amplitude is $2V_{EW1}-2V_R$)

For both high and low voltage modes of operation, the DC component of the signal $V_{ACTUATE}$ is zero.

$V_R$ preferably is a DC voltage level which may take a value between 0 and $V_{EW1}$. The peak to peak amplitude of $V_{ACTUATE}$ in the low voltage mode of operation can therefore be adjusted to any value between 0 Volts and $2V_{EW}$.

The signals V1 and V2 may either be generated externally, such as, for example, in a driver printed circuit board (PCB). The PCB may also contain a means to change the value of $V_R$ and therefore switch the amplitude of V1 in order to be able to generate either one of the alternative V1 signals (e.g. V1A as required for high voltage mode of operation or V1B for the low voltage mode of operation). Alternatively the thin film electronics 74 disposed upon the substrate 72 may be used to generate the V1 and V2 signals.

In either case, the first circuitry used for generating the V1 signal also includes a means for adjusting the high and low voltages of this signal, i.e. the value of $V_R$. Such a means may be realized by standard circuit design techniques, such as, for example, by level shifting circuits or ICs as are known to those of ordinary skill in the art.

In exemplary embodiments of the described AM-EWOD device, the first circuitry is configured to adjust the first time varying signal V1 temporally. The first circuitry may temporally adjust the first time varying voltage V1 by supplying a voltage having a first amplitude V1A to the plurality of array elements at a first time t1, and supplying a voltage having a second amplitude V1B to the plurality of array elements at a second time t2. The AM-EWOD device may perform a first droplet manipulation operation at the time t1 and a second droplet manipulation operation at the time t2. For example, the value of $V_R$ may therefore be adjustable between the first time and the second time for different usages and applications of the droplet manipulations of the AM-EWOD device. This adjustment of $V_R$ achieves different amplitude levels of V1B and may be made in accordance with the droplet operation that is being carried out by the device. For example, $V_R$ may be designed to be switchable between a value of 0 Volts and another value $V_{R1}$, between 0 Volts and $V_{EW1}$ in order to realize the high voltage and low voltage modes of operation described above, where the device can be switched between these two modes of operation.

Figure 7:
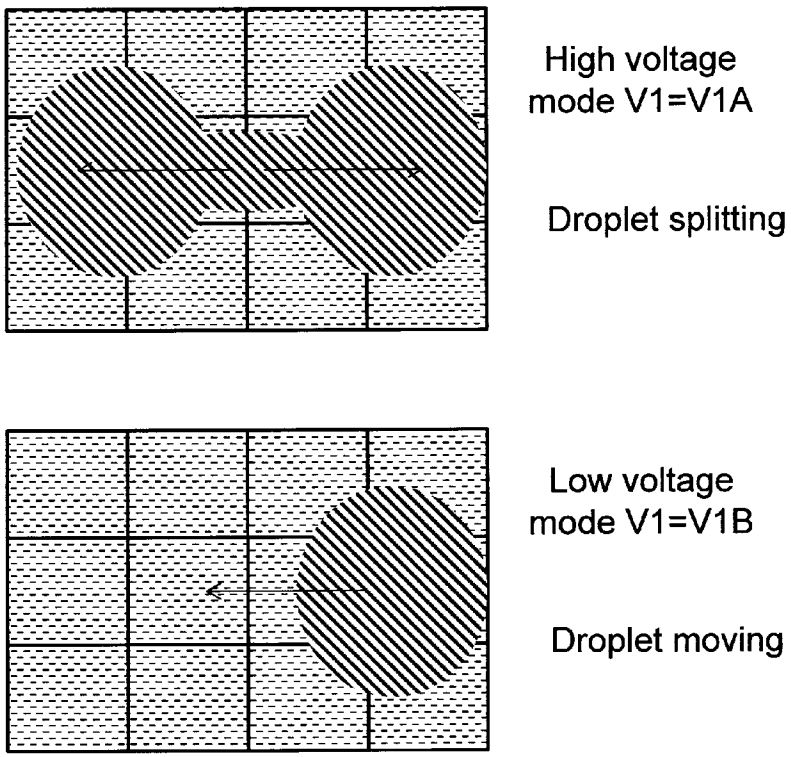
FIG. 7 is a schematic diagram depicting an example implementation of droplet operations in high and low voltage modes of operation utilized in the exemplary AM-EWOD device of FIG. 2.

FIG. 7 is a schematic diagram depicting an exemplary operation of the AM-EWOD device according to this embodiment in which V1 may be adjusted temporally to adjust the actuation voltage. In this exemplary operation, the low voltage mode of operation is used to perform the droplet operation of moving a droplet. The high voltage mode of operation is used for performing the operation of droplet splitting.

In general, the high voltage mode of operation may used for such times as when the device is performing a droplet operation where a high actuation voltage is specifically advantageous, such as, for example, droplet splitting or elution of a droplet from a reservoir. For other droplet operations, such as, for example, droplet moving, merging of two droplets, or droplet mixing, the low voltage mode of operation is to be preferred. The operation of the AM-EWOD device, and specifically the actuation voltage, and even more specifically the use of high and low voltage levels of the V1 voltage pulse, is thus controlled in accordance with the droplet operation that is being performed.

The described device thus provides a means for adjusting the actuation voltage whilst simultaneously operating the device with an AC drive scheme of type as described in U.S. Pat. No. 8,173,000 and referenced in the background art section.

The described device further provides a means for implementing such a variable voltage method of AC drive scheme by varying the voltage levels of the V1 signal only.

The advantages of the described device and related methods of operation, whereby by varying the actuation voltage such that the high voltage mode of operating is reserved only for droplet operations when it is really advantageous (e.g. droplet moving), are as follows:

- Operating in low voltage mode where possible helps to preserve a thin oil film between the liquid droplet 4 and the hydrophobic surface 16. This has several advantages:
  - Preservation of the oil film reduces the likelihood of bio-fouling of the hydrophobic surface.
  - Preservation of the oil film improves the reliability of the device, e.g. by minimizing the rate of pinhole defect generation due to imperfections in the insulator layer 20.
  - Preservation of the oil film may result in improved droplet dynamics.
- Operating in low voltage mode where possible also reduces power consumption by the device.

A further advantage of the invention is that it implements an AC method of driving the array elements. AC driving is known to those of ordinary skill in the art to be significantly superior to DC methods of driving, as described and explained in further detail in the references described in the background art section.

A further advantage of the invention is that the AC method of driving the array elements as implemented facilitates operation whereby the voltage amplitude of signals that must be switched by transistor elements of the thin film electronics 74 formed on the lower substrate 72 is not required to exceed $V_{EW}$, thus realizing the advantages of U.S. Pat. No. 8,173,000 referenced in the background art section.

Another advantage of this embodiment is that it describes a particularly simple implementation for realizing the high voltage mode and low voltage mode methods of driving. The two modes of operation may be implemented with minimal additional electronic circuitry being required.

In additional exemplary embodiments of the described AM-EWOD device, the first circuitry is configured to adjust the first time varying signal V1 spatially. In particular, the first circuitry may spatially adjust the first time varying voltage V1 by supplying a voltage having the first amplitude V1A to a first portion of the plurality of array elements, and supplying a voltage having the second amplitude V1B to a second portion of the plurality of array element electrodes. In such embodiment, the first portion of the plurality of array elements may constitute a first zone of operation for performing a first droplet manipulation operation, and the second portion of the plurality of array elements may constitute a second zone of operation for performing a second droplet manipulation operation.

Figure 8C:
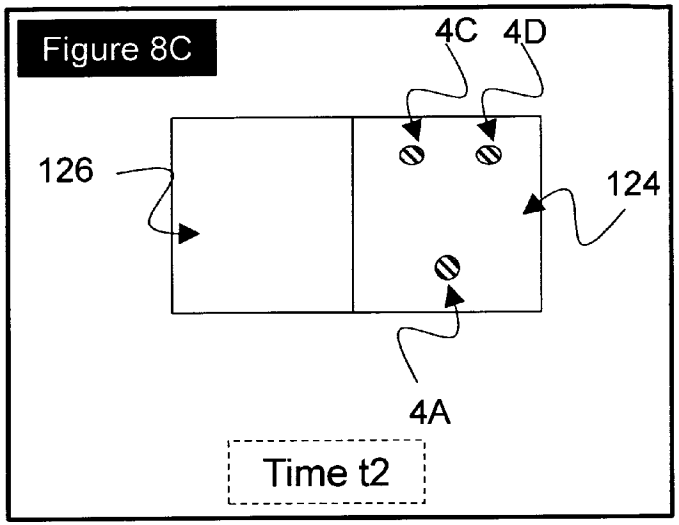
FIG. 8 is a schematic diagram depicting a further example implementation of droplet operations in high and low voltage modes of operation utilized in the exemplary AM-EWOD device of FIG. 2.
Figure 8D:
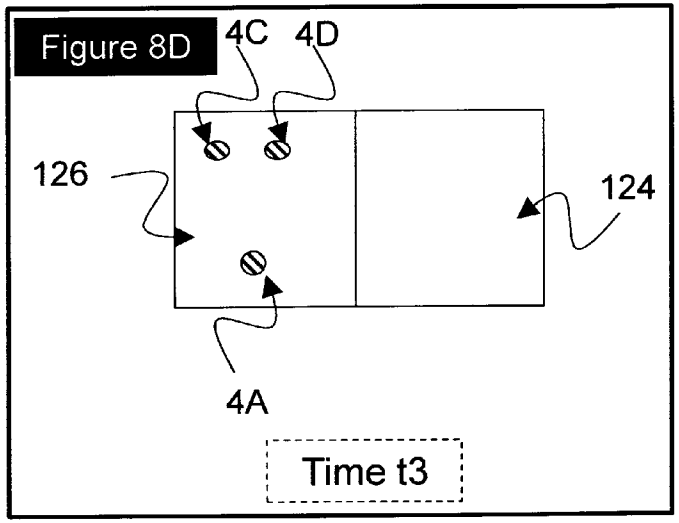
Figure 8A:
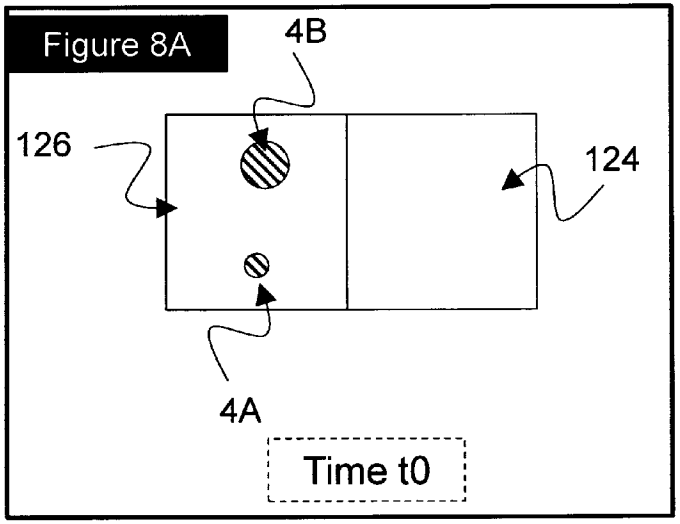
Figure 8B:
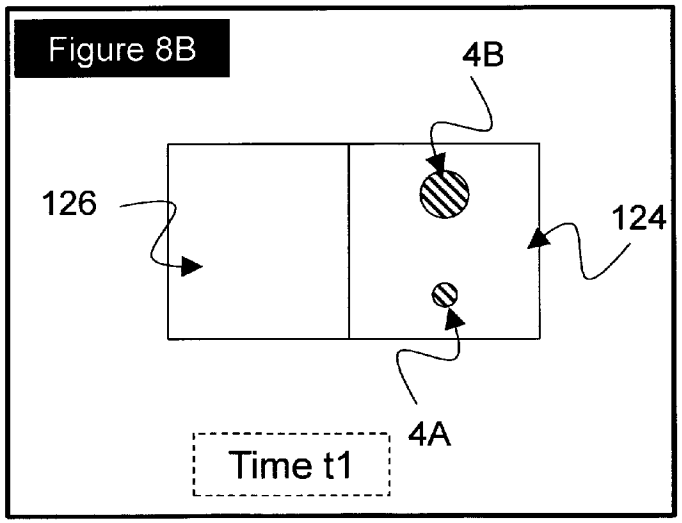

FIG. 8 is a schematic diagram depicting an exemplary embodiment in which spatially adjusting the first time varying voltage V1 is employed for implementation of varying droplet operations. FIG. 8 shows operation of an example array having two designated zones, a high voltage zone of operation 124 and a low voltage zone of operation 126. According to this example implementation, the device is only operated in high voltage mode when all liquid droplets have been removed from the low voltage zone of operation 126. The figure shows an example sequence of operation. The initial situation is shown in FIG. 8A at an initial time t0. The array has two droplets 4A and 4B upon it, with both droplets initially residing in the low voltage zone 126. By way of example, an intended droplet manipulation may be to split droplet 4B into two sub-droplets. An example protocol for implementing such a procedure may then be as follows:

(1) Both droplet 4A and droplet 4B are initially moved out of the low voltage zone 126 and into the high voltage zone 124. To perform this "move" operation, the device is operated in low voltage mode (signal V1=V1B). When this operation is completed, at a later time t1, the situation shown in FIG. 8B is present.

(2) Droplet 4B is now split into two daughter droplets 4C and 4D. To perform this "split" operation the device is operated in high voltage mode (signal V1=V1A). At all times during this operation, all droplets remain entirely within the high voltage zone 124. Following the completion of this operation, at a later time t2, the situation shown in FIG. 8C is now present.

(3) Droplets 4A, 4C and 4D are now moved from the high voltage zone 124 back to the low voltage zone 126. To perform this "move" operation the device is once again operated in low voltage mode (signal V1=V1B). At the completion of this operation, at time t3, the situation shown in FIG. 8D is present.

The overall result of this example procedure has been to split droplet 4B into sub-droplets 4C and 4D. By performing the operation in this way, the split has been undertaken without ever having to operate the device in high voltage mode whilst fluid was present in the low voltage zone 126. The low voltage zone 126 can therefore be organized so that liquid droplets are never actuated with signal V1A within the low voltage zone. An advantage of this implementation of the embodiment is that low voltage zones within the device can be defined which are free from surface contamination/biofouling since the oil layer is continuously preserved whenever and wherever droplets are within the low voltage zone.

A second embodiment of an AM-EWOD device may be configured comparably as the first embodiment described above, but with an alternative design of thin film electronics 74.

Figure 9:
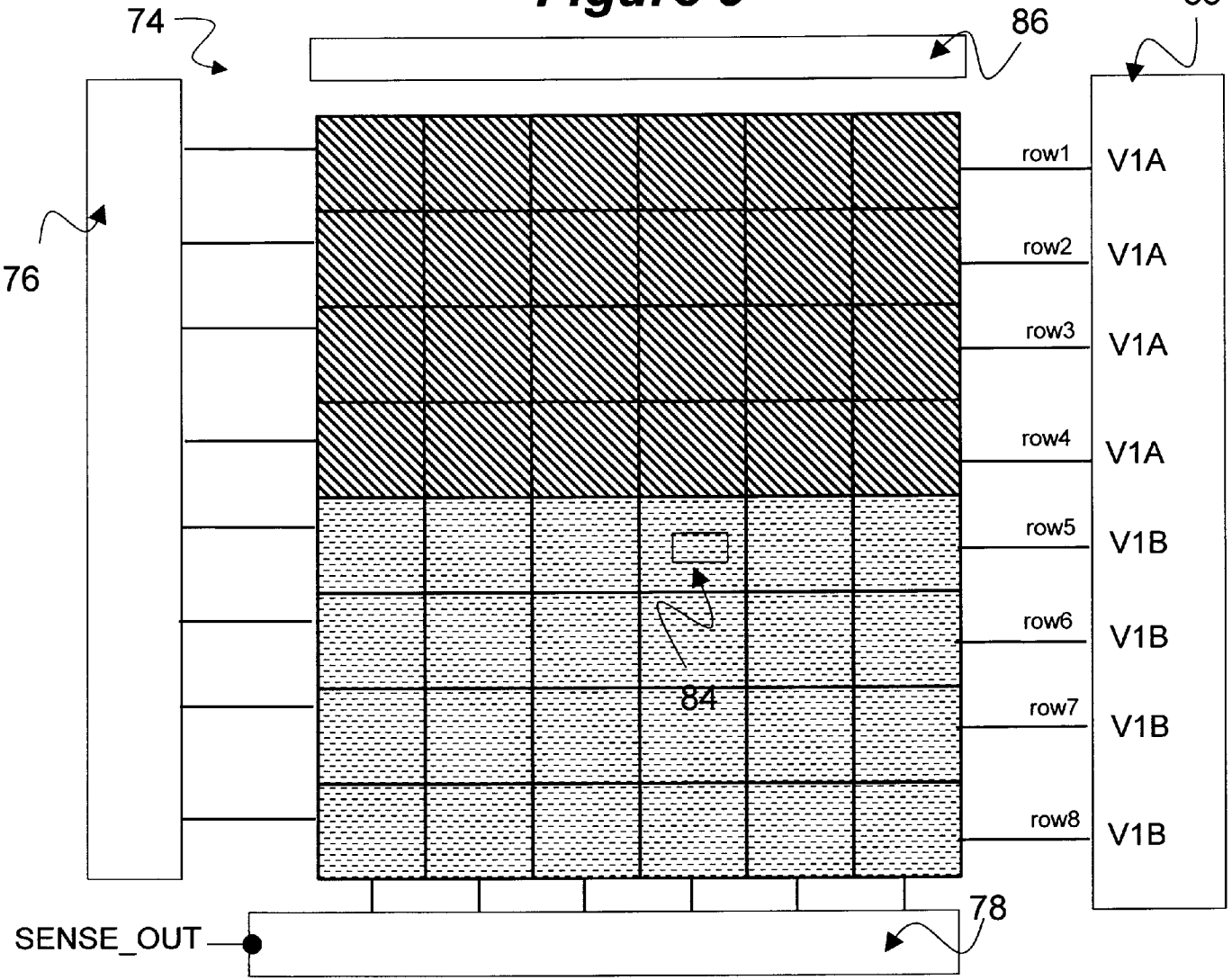
FIG. 9 is a schematic diagram depicting an arrangement of thin film electronics in an exemplary AM-EWOD device in accordance with a second embodiment of the invention.

FIG. 9 is a schematic diagram depicting an exemplary arrangement of a portion of the thin film electronics 74 according to this second embodiment of the invention. The array element circuit 84, row driver circuit 76, column driver circuit 78 and column detection circuit 86 may all be of similar or identical design to the first embodiment. The thin film electronics may also contain further features described in the first embodiment and not included on the diagram of FIG. 9, such as, for example, a serial interface 80 and connecting wires 82. The thin film electronics 74 contains additionally a signal generation circuit 88 which may be used to generate and supply signal V1 (such as V1A or V1B) to each row of the array individually. Signals V1A and V1B may be as specified for the first embodiment and used for operation in the high voltage mode and low voltage mode respectively.

Signal V1A may be supplied to certain rows of the array, and signal V1B may be applied to other rows of the array. For the example arrangement shown in FIG. 9, signals V1A may be supplied to each of rows 1 to 4 and a signal V1B may be supplied to each of rows 5-8 in an array including eight rows in total.

It will further be apparent to one skilled in the art how the routing of signals V1A and V1B to the different rows of the array could be arbitrarily arranged. It will further be appreciated that signals V1A and V1B could be arranged instead, for example, to apply the different V1 signals to the different columns of the arrays.

Figure 10:
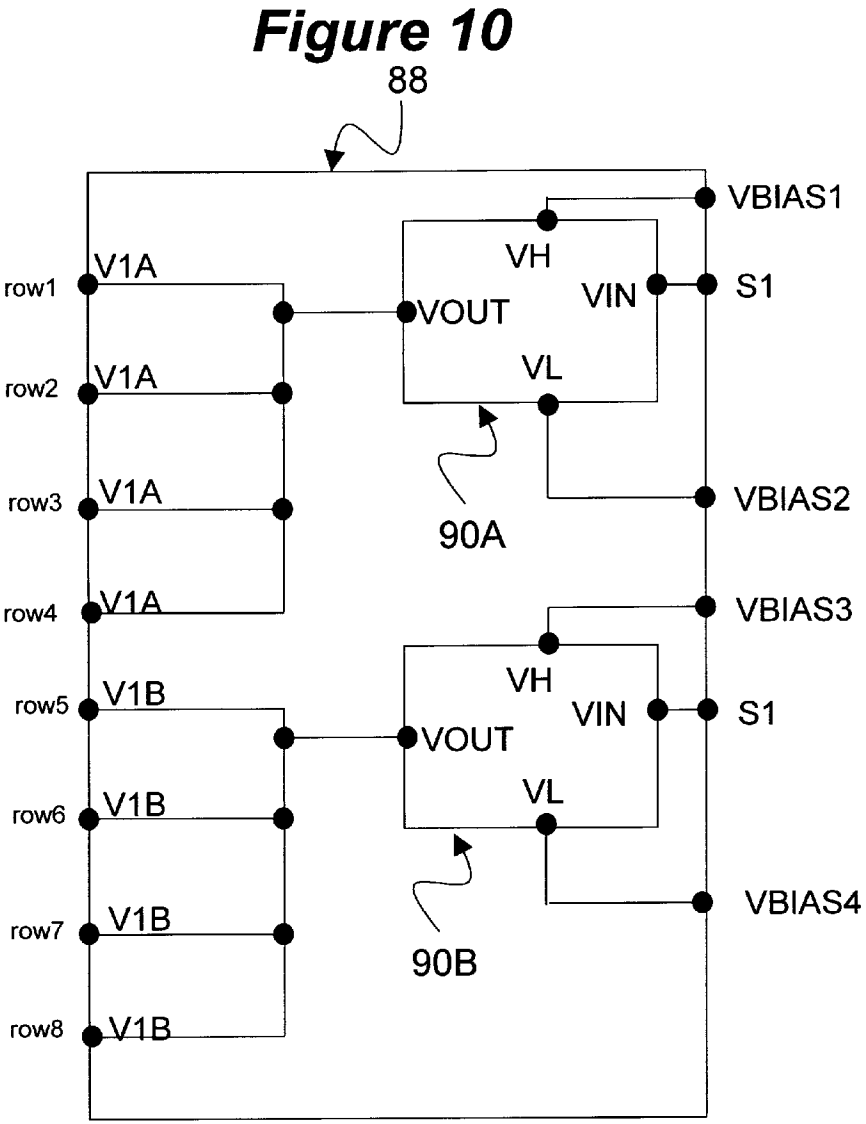
FIG. 10 is a schematic diagram depicting an example implementation of a signal generation circuit utilized with the thin film electronics of FIG. 9.

FIG. 10 is a schematic diagram depicting an example design of a suitable first signal generation circuit 88 in accordance with the second embodiment. The first signal generation circuit 88 includes the following components:

A first level shifter circuit 90A of standard construction known to those of ordinary skill in the art; and A second level shifter circuit 90B of standard construction also known to those of ordinary skill in the art.

The signal generation 88 circuit has inputs S1, VBIAS1, VBIAS2, VBIAS3 and VBIAS4.

The first signal generation circuit 88 is connected as follows:

The input VBIAS1 is connected to the input VH of first level shifter circuit 90A. The input VBIAS2 is connected to the input VL of the first level shifter circuit 90A. The input VBIAS3 is connected to the input VH of the second level shifter circuit 90B. The input VBIAS4 is connected to the input VL of the second level shifter circuit 90B. The input S1 s connected to the inputs VIN of first level shifter circuit 90A and second level shifter circuit 90B. The output VOUT of level first shifter circuit 90A is connected to the outputs V1A of row 1, row 2, row 3 and row 4. The output VOUT of second level shifter circuit 90B is connected to the outputs V1B of rows, row 6, row 7 and row 8.

The input signal S1 may include a logic signal, which may for example be of 5 Volt amplitude and which corresponds to the signal pattern to be used to generate the drive waveform V1. Inputs VBIAS1, VBIAS2, VBIAS3 and VBIAS4 are DC voltage supplies of the following values:

VBIAS1=$V_{EW}$

VBIAS2=$-V_{EW}$

VBIAS3=$V_{EW}-V_R$

VBIAS4=$-V_{EW}+V_R$

The level shifter circuits 90A and 90B operate so as to level shift the input signal VIN so that the output signal VOUT has a high level voltage VH and a low level VL. The output of first level shifter circuit 90A therefore generates signal V1A (having high level VBIAS1=$V_{EW}$ and low level VBIAS2=$-V_{EW}$), and the output of second level shifter circuit 90B generates signal V1B (having high level VBIAS3=$V_{EW}-V_R$ and low level VBIAS4=$-V_{EW}+V_R$).

The signal generation circuit 88, therefore, operates so as to generate the voltage signal V1A, as previously described, and to supply this signal to rows 1-4 of the array, and to generate a voltage signal V1B, as previously described, and to supply this signal to rows 5-8 of the array.

According to the operation of the second embodiment, having an arrangement of thin film electronics 74 as shown in FIGS. 9-10, rows 1-4 of the array are configured to operate in high voltage mode, whilst rows 5-8 of the array are configured to operate in low voltage. It should be noted that in this second embodiment, as in the first embodiment, signal V2 is applied to the top substrate electrode 28 which is common to all elements within the array. It should further be noted that this second embodiment (1) provides a means to operate different regions of the array with different actuation voltages, (2) whilst simultaneously operating with an AC method of driving, and (3) while also simultaneously limiting the voltage that must be switched the transistors of the thin film electronics 74 to $V_{EW}$. The simultaneous implementation of operations (1)-(3) is realized by the method of driving described herein, namely that the distinction between the high and low voltage modes of operation is in the high and low levels of the signal V1 only, with signal V2 being unchanged between the two modes of operation.

According to the operation of the second embodiment, an AM-EWOD device can be realized with dedicated high voltage and low voltage zones of operation. These different zones of operation may therefore be used for different droplet operations as part of example assay protocols. For example, in the described arrangement of FIG. 9, rows 1-4 could be used only for assay steps requiring the elution of droplets and their splitting into sub-droplets. Rows 5-8 could therefore be used solely for low voltage operations, such as, for example, moving, mixing and merging droplets.

An advantage of this second embodiment is that it realizes an array architecture having dedicated regions of high voltage and low voltage operation, whereby both zones can be operated simultaneously and with different actuation voltages.

Figure 11:
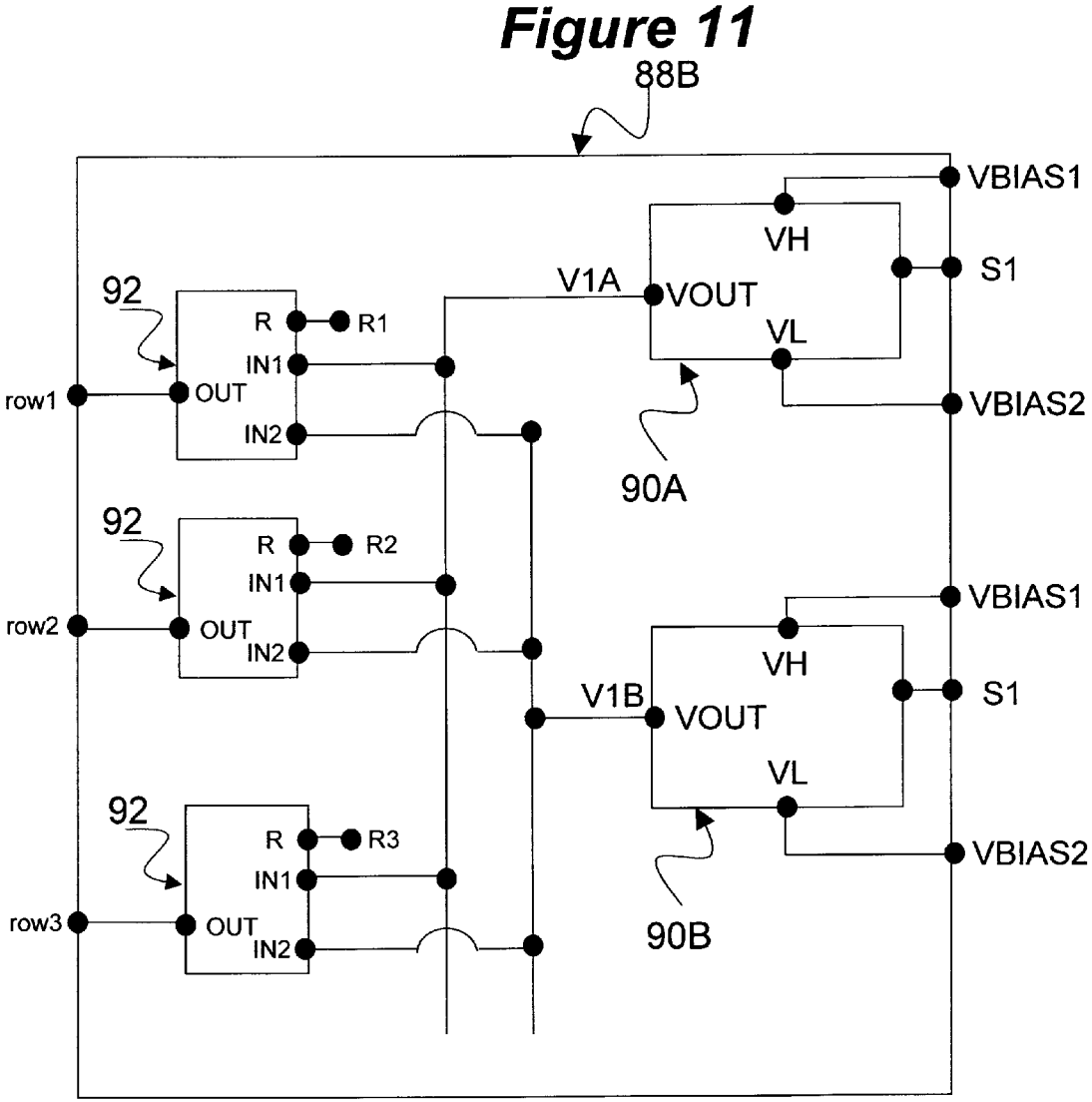
FIG. 11 is a schematic diagram depicting another example implementation of a signal generation circuit for thin film electronics according to a third embodiment of the invention.

FIG. 11 is a schematic diagram depicting a third embodiment, which is comparable to the second embodiment and having an alternative design of a second signal generation circuit 88B. The second signal generation circuit 88B may include the following elements:

First and second level shifter circuits 90A and 90B comparably as in the previous embodiment, and A multiplexer circuit 92 for each row output row N where N is an integer row designation (e.g., row 1, row 2 and row 3 outputs are shown in the Figure).

The second signal generation circuit 88B is connected as follows: The input VBIAS1 is connected to the input VH of the first level shifter circuit 90A. The input VBIAS2 is connected to the input VL of the first level shifter circuit 90A. The input VBIAS3 is connected to the input VH of the second level shifter circuit 90B. The input VBIAS4 is connected to the input VL of the second level shifter circuit 90B. The input S1 is connected to the inputs VIN of first level shifter circuit 90A and second level shifter circuit 90B. The output VOUT of first level shifter circuit 90A is connected to the input IN1 of each of the multiplexer circuits 92. The output VOUT of second level shifter 90B is connected to the input IN2 of each of the multiplexer circuits 92. Inputs R1, R2, R3, . . . etc are connected to input R of the multiplexer circuit of rows 1, 2, 3, . . . etc. The output OUT of each of the multiplexer circuits is connected to the corresponding output row N (row 1, row 2, row 3 . . . etc.)

The operation of the second signal generation circuit 88B is as follows:

The DC voltage supplies have the following values

VBIAS1=$V_{EW}$

VBIAS2=$-V_{EW}$

VBIAS3=$V_{EW}-V_R$

VBIAS4=$-V_{EW}+V_R$

The output of the first level shifter circuit 90A therefore is therefore signal V1A, and the output of level shifter circuit 90B is signal V1B as previously described.

Each of the multiplexer circuits 92 is configured so that either one of input IN1 or IN2 is passed through to the output OUT in accordance with the logical value at input R. The circuit is arranged so that each multiplexer may be configured individually, so that for each row output row N either signal V1A or signal V1B is generated in accordance with the input R of the multiplexer circuit in rowN.

According to this embodiment, each row of the array may be individually configured and re-configured so as to operate in high voltage mode or low voltage mode. An advantage of this embodiment is that the array is fully reconfigurable, and each individual row may be separately configured to operate in high voltage or in low voltage mode at any point in time.

It will be apparent to one skilled in the art how various modifications to the described embodiments could also be realized. For example, high voltage and low voltage zones of operation could be realized on a per-row instead of on a per-column basis. It will also be appreciated how the principles of the described embodiments could be extended to operate the AM-EWOD device with more than two different actuation voltage levels, and more than two zones of operation.

Figure 12:
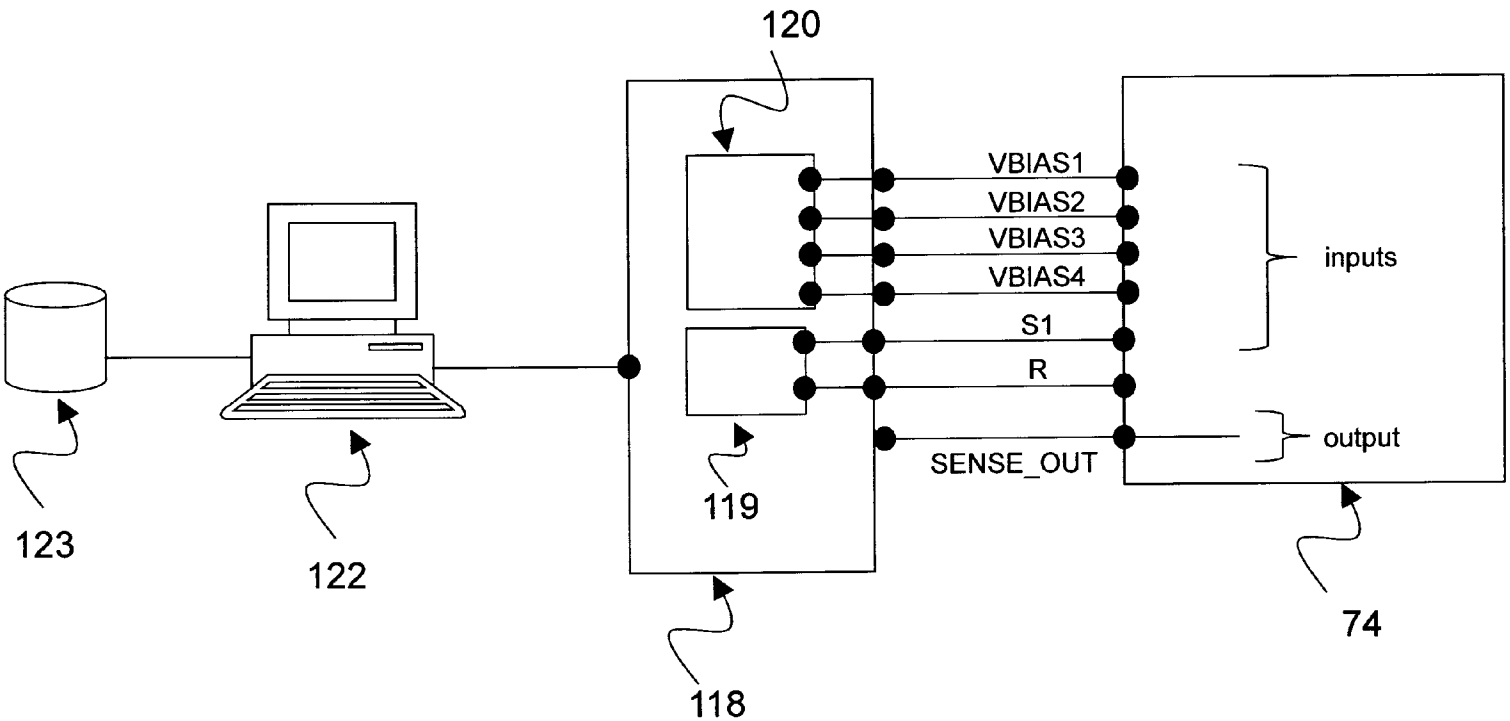
FIG. 12 is a schematic diagram depicting an example implementation of voltage control with sensor feedback according to a fourth embodiment of the invention.

FIG. 12 is a schematic diagram depicting a fourth embodiment. The fourth embodiment describes a system for implementing any of the previous embodiments (and suitable variations thereof), which may also optionally include the use of feedback. FIG. 12 shows an AM-EWOD device having which incorporates thin film electronics 74 on a lower substrate as previously described with respect to other embodiments. The thin film electronics include the first circuitry and the second circuitry configured respectively to supply the voltages V1 and V2 to the array elements as described above. The electrical inputs to the thin film electronics 74 may include logic signal S1 and bias voltages VBIAS1, VBIAS2, VBIAS3 and VBIAS4 as also previously described. The electrical inputs may also include serial data R that may be used to configure the multiplexer circuits of the embodiments including the second signal generator circuit 88B.

The thin film electronics may also include a sensor function having an output SENSE_OUT also as previously described. The lower substrate is connected to external drive electronics 118, which may for example consist of a printed circuit board (PCB). The external drive electronics may contain, for example, a voltage generation circuit 120 for generating DC bias voltages and a timing generation circuit 119 (e.g., a microcontroller or a field programmable gate array FPGA) for generating timing signals including the timing signal S1. The external drive electronics may be connected to and controlled by a computer 122 running application software 123 stored in a non-transitory computer readable medium. The application software 123 may be configured so as to be executed by the computer to control the external drive electronics, for example to control the level of the DC bias voltages VBIAS1, VBIAS2, VBIAS3 and VBIAS4, and to control the logic signal S1 and serial data R in accordance with the droplet operation being performed. The application software may also control these inputs in response to the measured output signal SENSE_OUT from the sensor circuitry to implement feedback control of the external drive electronics. The control functions implemented by the application software 123 may incorporate some or all of the following rules of operation:

Configuring actuation voltages in accordance with the droplet operation being performed;

Configuring actuation voltages so as to maintain dedicated high voltage zones and low voltage zones of operation; and Configuring actuation voltages in accordance with the properties of the liquid droplets being manipulated. For example, different actuation voltages may be required to move or to split droplets of different materials, having different surfactant concentrations or having different viscosities.

In combination with the sensor output SENSE_OUT, which may be used to determine the positions of liquid droplets within the array, the application software may be further configured to incorporate some or all of the following rules of operation:

Modulating the actuation voltage to determine the minimum required to successfully implement the required droplet operation. For example, when moving a droplet from position A to position B, an appropriate pattern of actuated electrodes can be defined on the device, and then the actuation voltage is increased gradually in steps, until the actuation voltage required to effect the move operation is reached. The successful implementation of the move operation may be verified from the detected position of the droplet as determined from the sensor output SENSE_OUT.

Modulating the actuation voltage in accordance with the size of the droplet as measured from the sensor output SENSE_OUT.

It will be further apparent that the AM-EWOD device described could form part of a complete lab-on-a-chip system. Within such as system, the droplets sensed and/or manipulated in the AM-EWOD device could be chemical or biological fluids, e.g. blood, saliva, urine, etc, and that the whole arrangement could be configured to perform a chemical or biological test or to synthesize a chemical or biochemical compound.

In accordance with the above, an aspect of the invention is an active matrix electrowetting on dielectric (AM-EWOD) device. Embodiments of the AM-EWOD device include a substrate electrode and a plurality of array elements, each array element including an array element electrode. First circuitry is configured to supply a first time varying signal V1 to at least a portion of the array element electrodes, and second circuitry is configured to supply a second time varying signal V2 to the substrate electrode, wherein an actuation voltage is defined by a potential difference between V2 and V1. The first circuitry further is configured to adjust the amplitude of V1 to adjust the actuation voltage.

In exemplary embodiments of the AM-EWOD device, the first circuitry is configured to adjust the amplitude of V1 between a first amplitude V1A and a second amplitude V1B, wherein V1A is greater than V1B, and V1A is associated with a high voltage mode of operation and V1B is associated with a low voltage mode of operation.

In exemplary embodiments of the AM-EWOD device, the first circuitry is further configured to adjust the amplitude of the first time varying signal V1 from V1A to V1B by applying a DC voltage $V_R$ to the first time varying signal.

In exemplary embodiments of the AM-EWOD device, the DC voltage $V_R$ is adjustable to achieve different amplitude levels of V1B.

In exemplary embodiments of the AM-EWOD device, the first circuitry is configured to adjust the first time varying signal V1 temporally. The first circuitry temporally adjusts the first time varying voltage V1 by supplying a voltage having a first amplitude V1A to the plurality of array elements at a first time t1, and supplying a voltage having a second amplitude V1B to the plurality of array elements at a second time t2. The AM-EWOD device performs a first droplet manipulation operation at the time t1 and a second droplet manipulation operation at the time t2.

In exemplary embodiments of the AM-EWOD device, the first circuitry is configured to adjust the first time varying signal V1 spatially. The first circuitry spatially adjusts the first time varying voltage V1 by supplying a voltage having a first amplitude V1A to a first portion of the plurality of array elements, and supplying a voltage having a second amplitude V1B to a second portion of the plurality of array element electrodes.

In exemplary embodiments of the AM-EWOD device, the first plurality of array elements is a first zone of operation for performing a first droplet manipulation operation, and the second portion of the plurality of array elements is a second zone of operation for performing a second droplet manipulation operation.

In exemplary embodiments of the AM-EWOD device, the first zone of operation is a high voltage zone of operation, and the second zone of operation is a low voltage zone of operation.

In exemplary embodiments of the AM-EWOD device, the first circuitry includes a first level shifter circuit to supply the voltage having the first amplitude V1A to the first portion of the plurality of array elements, and a second level shifter circuit to supply the voltage having the second amplitude V1B to the second portion of the plurality of array element electrodes.

In exemplary embodiments of the AM-EWOD device, the amplitude of V1 is adjusted to adjust the actuation voltage while the amplitude of V2 remains unchanged.

In exemplary embodiments of the AM-EWOD device, the AM-EWOD device further includes thin film electronics that includes the first circuitry and the second circuitry, a substrate upon which the thin film electronics is disposed, external drive electronics configured to drive the first circuitry and the second circuitry of the thin film electronics, sensor circuitry configured to implement feedback control of the external drive electronics, and a non-transitory computer readable medium storing a computer program that is executed to control the external drive electronics.

Another aspect of the invention is a method of controlling an actuation voltage to be applied to a plurality of array elements of an active matrix electrowetting on dielectric (AM-EWOD) device, the AM-EWOD device having a substrate electrode and a plurality of array elements, each array element including an array element electrode, wherein the actuation voltage is defined by a potential difference between the substrate electrode and the array element electrodes. The method of controlling the actuation voltage includes the steps of: supplying a first time varying signal V1 to at least a portion of the array element electrodes, supplying a second time varying signal V2 to the substrate electrode, and controlling the actuation voltage by adjusting the amplitude of V1 to adjust the actuation voltage.

In exemplary embodiments of the method of controlling an actuation voltage, the amplitude of V1 is adjusted between a first amplitude V1A and a second amplitude V1B, V1A is greater than V1B, and V1A is associated with a high voltage mode of operation and V1B is associated with a low voltage mode of operation.

In exemplary embodiments of the method of controlling an actuation voltage, the amplitude of the first time varying signal V1 is adjusted from V1A to V1B by applying a DC voltage $V_R$ to the first time varying signal.

In exemplary embodiments of the method of controlling an actuation voltage, the DC voltage $V_R$ is adjustable to achieve different amplitude levels of V1B.

In exemplary embodiments of the method of controlling an actuation voltage, the first time varying signal V1 is adjusted temporally by supplying a voltage having a first amplitude V1A to the plurality of array elements at a first time t1, and supplying a voltage having a second amplitude V1B to the plurality of array elements at a second time t2. The AM-EWOD device performs a first droplet manipulation operation at the time t1 and a second droplet manipulation operation at the time t2.

In exemplary embodiments of the method of controlling an actuation voltage, the first time varying signal V1 is adjusted spatially by supplying a voltage having a first amplitude V1A to a first portion of the plurality of array elements, and supplying a voltage having a second amplitude V1B to a second portion of the plurality of array element electrodes.

In exemplary embodiments of the method of controlling an actuation voltage, the first plurality of array elements is a first zone of operation for performing a first droplet manipulation operation, and the second portion of the plurality of array elements is a second zone of operation for performing a second droplet manipulation operation.

In exemplary embodiments of the method of controlling an actuation voltage, the first zone of operation is a high voltage zone of operation, and the second zone of operation is a low voltage zone of operation.

In exemplary embodiments of the method of controlling an actuation voltage, the amplitude of V1 is adjusted to adjust the actuation voltage while the amplitude of V2 remains unchanged.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

The described embodiments used be used to provide an enhance AM-EWOD device. The AM-EWOD device could form a part of a lab-on-a-chip system. Such devices could be used in manipulating, reacting and sensing chemical, biochemical or physiological materials. Applications include healthcare diagnostic testing, chemical or biochemical material synthesis, proteomics, tools for research in life sciences and forensic science.

The invention claimed is:

1. An active matrix electrowetting on dielectric (AM-EWOD) device comprising:

a substrate electrode;

a plurality of array elements, each array element including an array element electrode;

first circuitry configured to supply a first time varying signal V1 to at least a portion of the array element electrodes; and second circuitry configured to supply a second time varying signal V2 to the substrate electrode;

wherein an actuation voltage is defined by a potential difference between V2 and V1, and the first circuitry further is configured to adjust the amplitude of V1 to adjust the actuation voltage;

wherein the first circuitry is configured to adjust the amplitude of V1 between a first amplitude V1A and a second amplitude V1B, wherein V1A is greater than V1B, and V1A is associated with a high voltage mode of operation and V1B is associated with a low voltage mode of operation; and wherein the first circuitry comprises a signal generation circuit that is configured to adjust the first time varying signal V1 spatially, and the signal generation circuit spatially adjusts the first time varying voltage V1 by supplying a voltage having a first amplitude V1A to a first portion of the plurality of array element electrodes, and supplying a voltage having a second amplitude V1B to a second portion of the plurality of array element electrodes.

2. The AM-EWOD device of claim 1, wherein the first circuitry is further configured to adjust the amplitude of the first time varying signal V1 from V1A to V1B by applying a DC voltage $V_R$ to the first time varying signal.

3. The AM-EWOD device of claim 2, wherein the DC voltage $V_R$ is adjustable to achieve different amplitude levels of V1B.

4. The AM-EWOD device of claim 1, wherein the first circuitry is configured to adjust the first time varying signal V1 temporally;

wherein the first circuitry temporally adjusts the first time varying voltage V1 by supplying a voltage having a first amplitude V1A to the plurality of array element electrodes at a first time t1, and supplying a voltage having a second amplitude V1B to the plurality of array element electrodes at a second time t2; and the AM-EWOD device performs a first droplet manipulation operation at the time t1 and a second droplet manipulation operation at the time t2.

5. The AM-EWOD device of claim 1, wherein the first portion of the plurality of array element electrodes is a first zone of operation for performing a first droplet manipulation operation, and the second portion of the plurality of array element electrodes is a second zone of operation for performing a second droplet manipulation operation.

6. The AM-EWOD device of claim 5, wherein the first zone of operation is a high voltage zone of operation, and the second zone of operation is a low voltage zone of operation.

7. The AM-EWOD device of claim 1, wherein the signal generation circuit comprises:

a first level shifter circuit to supply the voltage having the first amplitude V1A to the first portion of the plurality of array element electrodes; and a second level shifter circuit to supply the voltage having the second amplitude V1B to the second portion of the plurality of array element electrodes.

8. The AM-EWOD device of claim 1, wherein the first circuitry and the second circuitry are configured such that the first circuitry adjusts the amplitude of V1 while the second circuitry controls the amplitude of V2 to remain unchanged.

9. The AM-EWOD device of claim 1, further comprising:

thin film electronics that includes the first circuitry and the second circuitry;

a substrate upon which the thin film electronics is disposed;

external drive electronics configured to drive the first circuitry and the second circuitry of the thin film electronics;

sensor circuitry configured to implement feedback control of the external drive electronics; and a non-transitory computer readable medium storing a computer program that is executed to control the external drive electronics.

10. A method of controlling an actuation voltage to be applied to a plurality of array elements of an active matrix electrowetting on dielectric (AM-EWOD) device, the AM-EWOD device having a substrate electrode and a plurality of array elements, each array element including an array element electrode;

wherein the actuation voltage is defined by a potential difference between the substrate electrode and the array element electrodes;

the method of controlling the actuation voltage comprising the steps of:

supplying a first time varying signal V1 to at least a portion of the array element electrodes;

supplying a second time varying signal V2 to the substrate electrode; and controlling the actuation voltage by adjusting the amplitude of V1 to adjust the actuation voltage;

wherein the amplitude of V1 is adjusted between a first amplitude V1A and a second amplitude V1B;

V1A is greater than V1B;

and V1A is associated with a high voltage mode of operation and V1B is associated with a low voltage mode of operation; and wherein the first time varying signal V1 is adjusted spatially by a signal generation circuit supplying a voltage having a first amplitude V1A to a first portion of the plurality of array element electrodes, and supplying a voltage having a second amplitude V1B to a second portion of the plurality of array element electrodes.

11. The method of controlling an actuation voltage of claim 10, wherein the amplitude of the first time varying signal V1 is adjusted from V1A to V1B by applying a DC voltage $V_R$ to the first time varying signal.

12. The method of controlling an actuation voltage of claim 11, wherein the DC voltage $V_R$ is adjustable to achieve different amplitude levels of V1B.

13. The method of controlling an actuation voltage of claim 10, wherein:

the first time varying signal V1 is adjusted temporally by supplying a voltage having a first amplitude V1A to the plurality of array element electrodes at a first time t1, and supplying a voltage having a second amplitude V1B to the plurality of array element electrodes at a second time t2; and the AM-EWOD device performs a first droplet manipulation operation at the time t1 and a second droplet manipulation operation at the time t2.

14. The method of controlling an actuation voltage of claim 10, wherein the first portion of the plurality of array element electrodes is a first zone of operation and the second portion of the plurality of array element electrodes is a second zone of operation;

the method further comprising performing a first droplet manipulation in the first zone of operation, and performing a second droplet manipulation in the second zone of operation.

15. The method of controlling an actuation voltage of claim 14, wherein the first zone of operation is a high voltage zone of operation, and the second zone of operation is a low voltage zone of operation.

16. The method of controlling an actuation voltage of claim 12, wherein the amplitude of V1 is adjusted to adjust the actuation voltage while the amplitude of V2 remains unchanged.

* * * * *